US007434969B2

(12) United States Patent
Ford et al.

(10) Patent No.: US 7,434,969 B2
(45) Date of Patent: Oct. 14, 2008

(54) MULTI-FUNCTION LIGHT SUPPORT

(75) Inventors: Timothy Ford, Beaconsfield (CA); Stephane Gascon, Mascouche (CA)

(73) Assignee: The Flewelling Ford Family Trust, Beaconsfield (CA)

( * ) Notice: Subject to any disclaimer, the term of this patent is extended or adjusted under 35 U.S.C. 154(b) by 536 days.

(21) Appl. No.: 10/762,215

(22) Filed: Jan. 21, 2004

(65) Prior Publication Data

US 2005/0157488 A1 Jul. 21, 2005

(51) Int. Cl.
*F21L 2/00* (2006.01)

(52) U.S. Cl. ..... 362/382; 362/427; 362/430; 362/397; 362/298; 362/105

(58) Field of Classification Search ..... 362/382, 362/388–389, 397–398, 418–419, 429–430, 362/427, 432, 404, 422, 103, 105, 108, 190–191, 362/410–415, 431, 153, 153.1; 224/576, 224/181, 930

See application file for complete search history.

(56) References Cited

U.S. PATENT DOCUMENTS

| | | | | | |
|---|---|---|---|---|---|
| 1,772,439 | A * | 8/1930 | Garbs | 248/205.5 |
| 2,797,310 | A | 6/1957 | Moore | 362/311 |
| 3,713,614 | A | 1/1973 | Taylor | 248/632 |
| 3,936,670 | A * | 2/1976 | Allen, Sr. | 362/258 |
| 4,575,784 | A * | 3/1986 | Diau | 362/183 |
| 4,998,187 | A * | 3/1991 | Herrick | 362/103 |
| 5,249,108 | A * | 9/1993 | Gary | 362/388 |
| 5,386,356 | A | 1/1995 | Davis et al. | 362/267 |
| 5,611,510 | A * | 3/1997 | Yamamoto | 248/205.3 |
| 5,816,684 | A * | 10/1998 | Yu | 362/191 |
| 5,893,630 | A * | 4/1999 | Mosquera | 362/191 |
| 5,954,426 | A * | 9/1999 | Whittington | 362/414 |
| 6,457,838 | B1 * | 10/2002 | Dugmore et al. | 362/106 |
| 6,481,871 | B2 * | 11/2002 | Jamison | 362/287 |
| 6,618,906 | B2 * | 9/2003 | Ciesiun | 24/3.12 |
| 6,669,353 | B2 * | 12/2003 | Kung | 362/191 |
| 6,736,531 | B2 * | 5/2004 | Wallach | 362/414 |
| 6,877,875 | B2 * | 4/2005 | Yu et al. | 362/105 |
| 6,923,551 | B2 * | 8/2005 | Galli | 362/191 |

* cited by examiner

*Primary Examiner*—Jong-Suk (James) Lee
*Assistant Examiner*—Robert May
(74) *Attorney, Agent, or Firm*—Goudreau Gage Dubuc Hugh Mansfield

(57) ABSTRACT

A light support comprising a base plate and a light-carrying plate comprising a proximal end mounted to the base plate and being adapted for mounting a light thereon. The base plate comprises an anchoring element, an anti-tipping assembly and a concave support-mounting face. The anchoring element is adapted to be anchored within a penetrable material. The support mounting face co-acts with a surface on which the light support is mounted to. The light support further comprises an auxiliary element that comprises an auxiliary mounting element or an auxiliary anchoring element that can be moveable or stationary.

26 Claims, 10 Drawing Sheets

MULTI-FUNCTION LIGHT SUPPORT

FIELD OF THE INVENTION

The present invention relates to a support, more specifically the present invention is concerned with a multi-function light support.

BACKGROUND OF THE INVENTION

Portable light supports are well known in the art. Typically, such light supports are mounted to a surface or a user in a variety of ways in order to emit light therefrom. Light supports usually have a base member for attaching to a surface or a user and another member for mounting a light thereon which can be fixedly or pivotally mounted to the base member.

These light supports can be used in various industries such as mining or construction or for security, policing or military uses.

Among the drawbacks of prior art light supports is that the mounting surface is not adapted for mounting on a large variety of surfaces, and they tend to tip over when positioned on a flat surface without being fixed thereon.

There thus remains a need for an improved light support.

OBJECTS OF THE INVENTION

An object of the present invention is therefore to provide an improved light support.

SUMMARY OF THE INVENTION

More specifically, in accordance with the present invention, there is provided a light support comprising:

a base plate comprising an anchoring element adapted to be anchored within a penetrable material and a support-mounting face for co-acting with a surface, and a light-carrying plate comprising a proximal end mounted to the base plate and being adapted for mounting a light thereon.

In accordance with another aspect of the invention there is provided a light support comprising:

a base plate comprising an anti-tipping assembly mounted thereto and a support-mounting for co-acting with a surface, and a light-carrying plate comprising a proximal end mounted to the base plate and being adapted for mounting a light thereon.

When the support mounting face is positioned on a generally horizontal surface and the light carrying plate carries a light thereon, the anti-tipping assembly resists the light support tipping over.

In accordance with yet another aspect of the present invention there is provided a light support comprising:

a base plate comprising an anchoring element adapted to be anchored within a penetrable material, an anti-tipping assembly comprising at least one anti-tipping leg mounted to the base plate; and a concave support-mounting face for co-acting with a surface, and a light-carrying plate, the light-carrying plate adapted for mounting a light thereon, a proximal end thereof mounted to the base plate.

In accordance with yet another aspect of the present invention there is provided light support assembly comprising:

a base plate comprising:

a support-mounting face for co-acting with a surface;

an auxiliary element movably mounted thereto; and a support-mounting face for co-acting with a surface; and a light-carrying plate comprising a proximal end mounted to said base plate and being adapted for mounting a light thereon.

In accordance with yet a further aspect of the present invention there is provided a light and support assembly comprising:

a base plate comprising an anchoring element adapted to be anchored within a penetrable material, and support-mounting face for co-acting with a surface, and a light-carrying plate comprising a proximal end mounted to the base plate and being adapted for mounting a light thereon.

Other objects, advantages and features of the present invention will become more apparent upon reading of the following non-restrictive description of embodiments thereof, given by way of example only with reference to the accompanying drawings.

BRIEF DESCRIPTION OF THE DRAWINGS

In the appended drawings where like elements are referenced by like reference numerals and in which.

DESCRIPTION OF THE EMBODIMENTS

With reference to the appended drawings embodiments of the invention will be herein described so as to exemplify the invention only and not limit the scope thereof.

Figure 1:
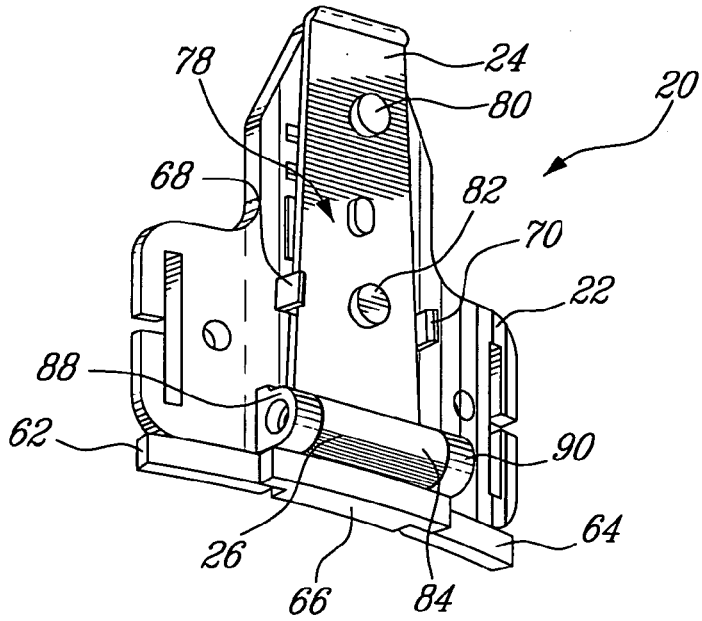
FIG. 1 is a perspective view of the multi-function light support in accordance with an embodiment of the invention.

FIG. 1 shows a light support 20 including a base plate 22 and a light carrying plate 24. The light carrying plate 24 is pivotally mounted to the base plate 22 at a proximal end 26 thereof.

Figure 2:
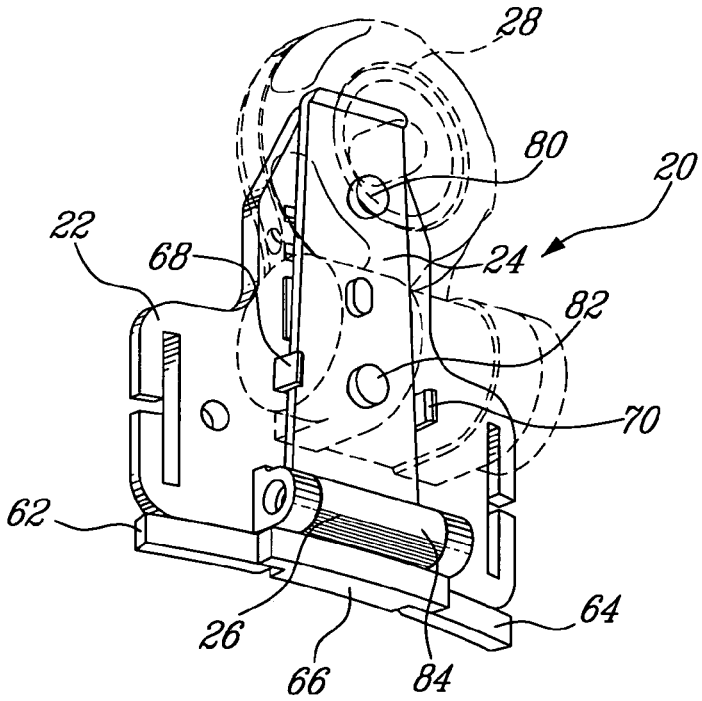
FIG. 2 is a perspective view similar to FIG. 1 showing a light mounted to the support.
Figure 3:
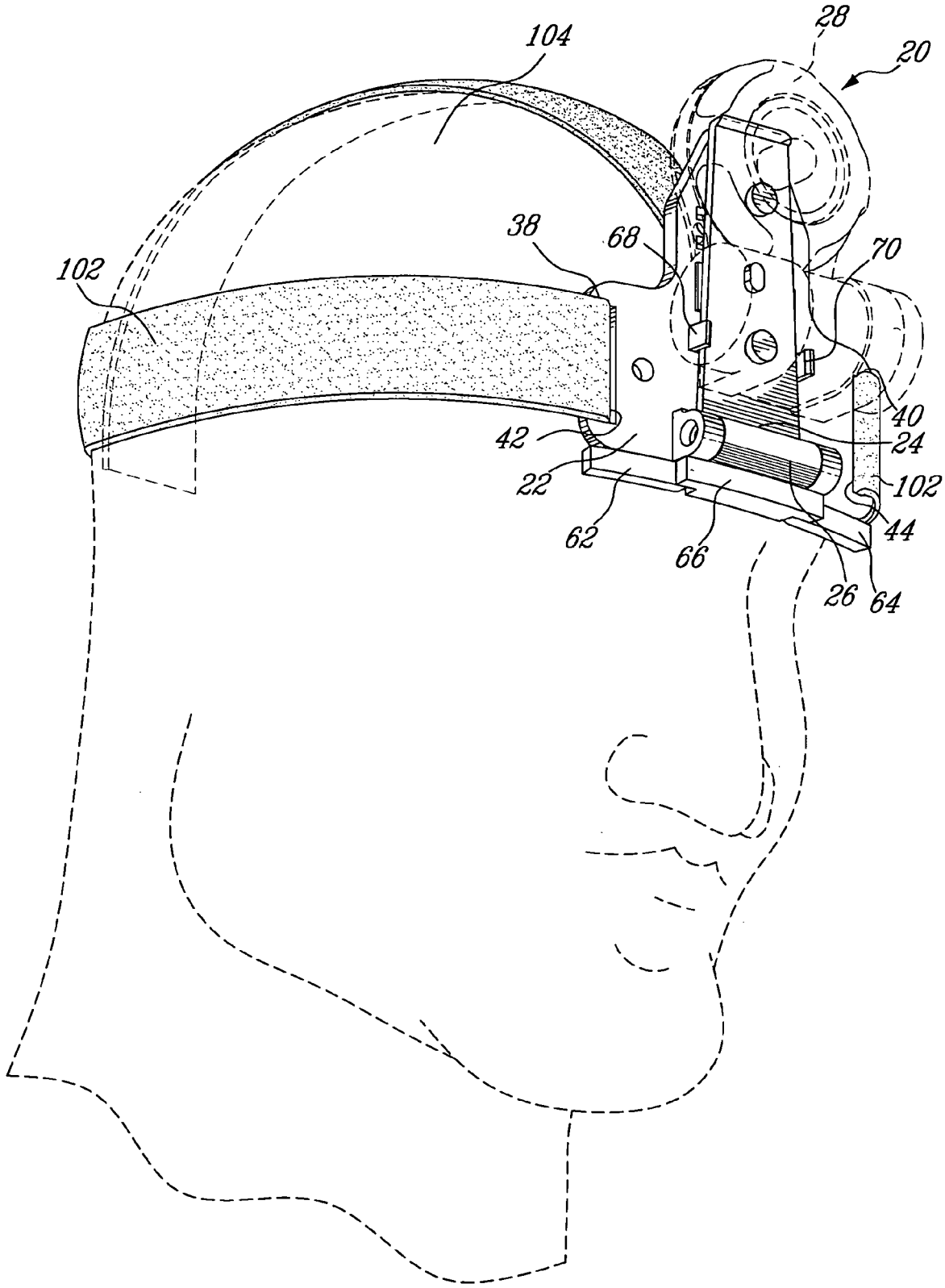
FIG. 3 shows the light and light support of FIG. 2 strapped onto the head of the user.

FIGS. 1, 2 and 3 show the light carrying plate 24 and base plate 22 in a folded position. FIGS. 5, 6, 7, and 8 show the light carrying plate and base plate in an unfolded position.

Figure 4:
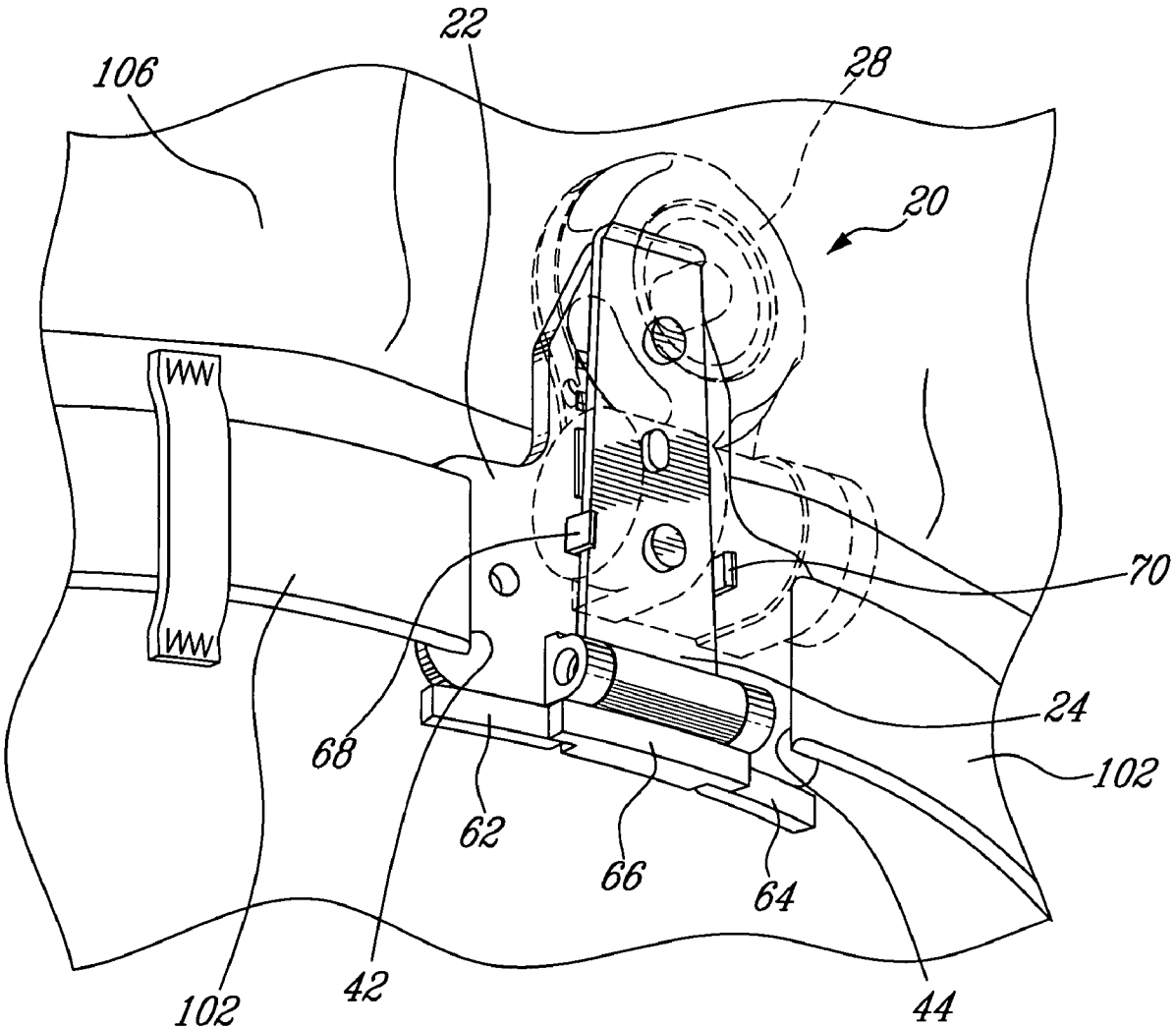
FIG. 4 shows the light and light support of FIG. 2 strapped to a user's waste.

The light carrying plate 24 is adapted to receive a light 28 thereon, as shown in FIGS. 2, 3, and 4.

As better shown in FIG. 7, the light support 20 includes a surface mounting face 30 for mounting to a surface, as will be described herein.

Figure 5:
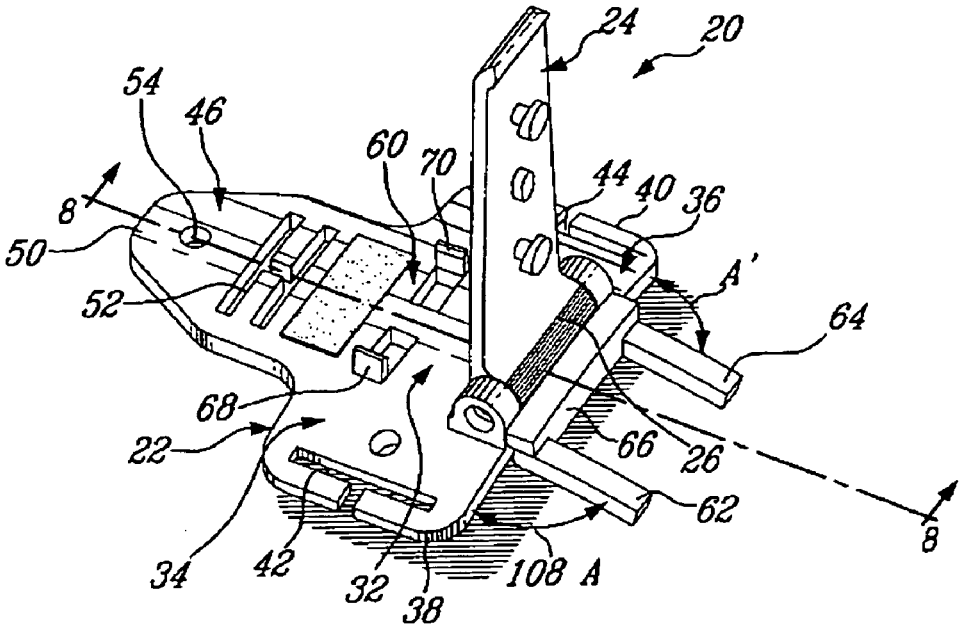
FIG. 5 shows the light support in accordance with an embodiment of the invention positioned on a flat horizontal surface.
Figure 6:
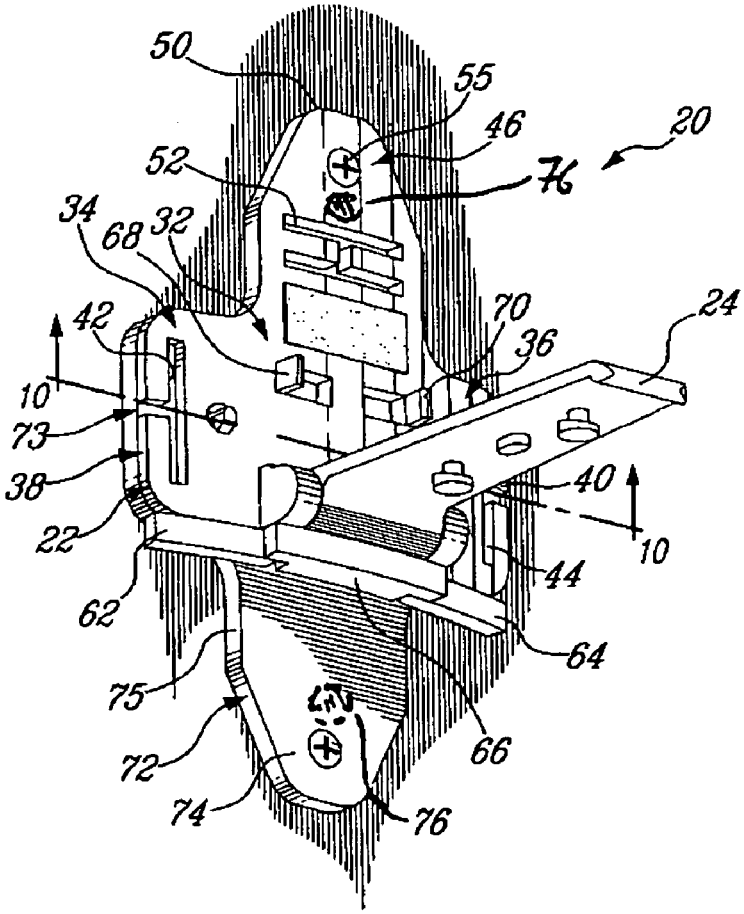
FIG. 6 shows the light support including an auxiliary element in accordance with another embodiment of the invention mounted to a vertical surface.
Figure 11:
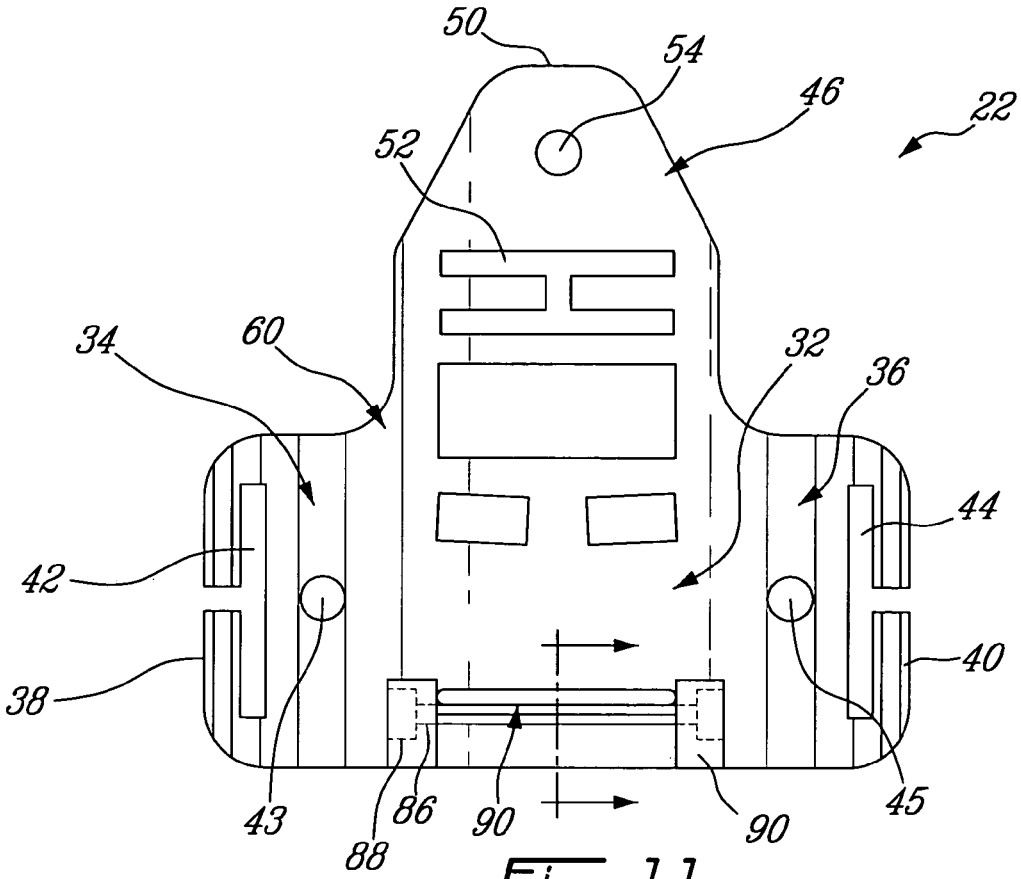
FIG. 11 is a top plan view of the base plate in accordance with an embodiment of the invention.

With particular reference to FIGS. 5, 6, and 11, the base plate 22 includes a middle portion or main body portion 32 having extensions or extending portions 34 and 36 on each side thereof which define the longitudinal ends 38 and 40 of base plate 22. Extensions 34 and 36 include respective strap receiving apertures 42 and 44 formed at ends 38 and 40 as well as fastener-receiving apertures 43 and 45.

Figure 7:
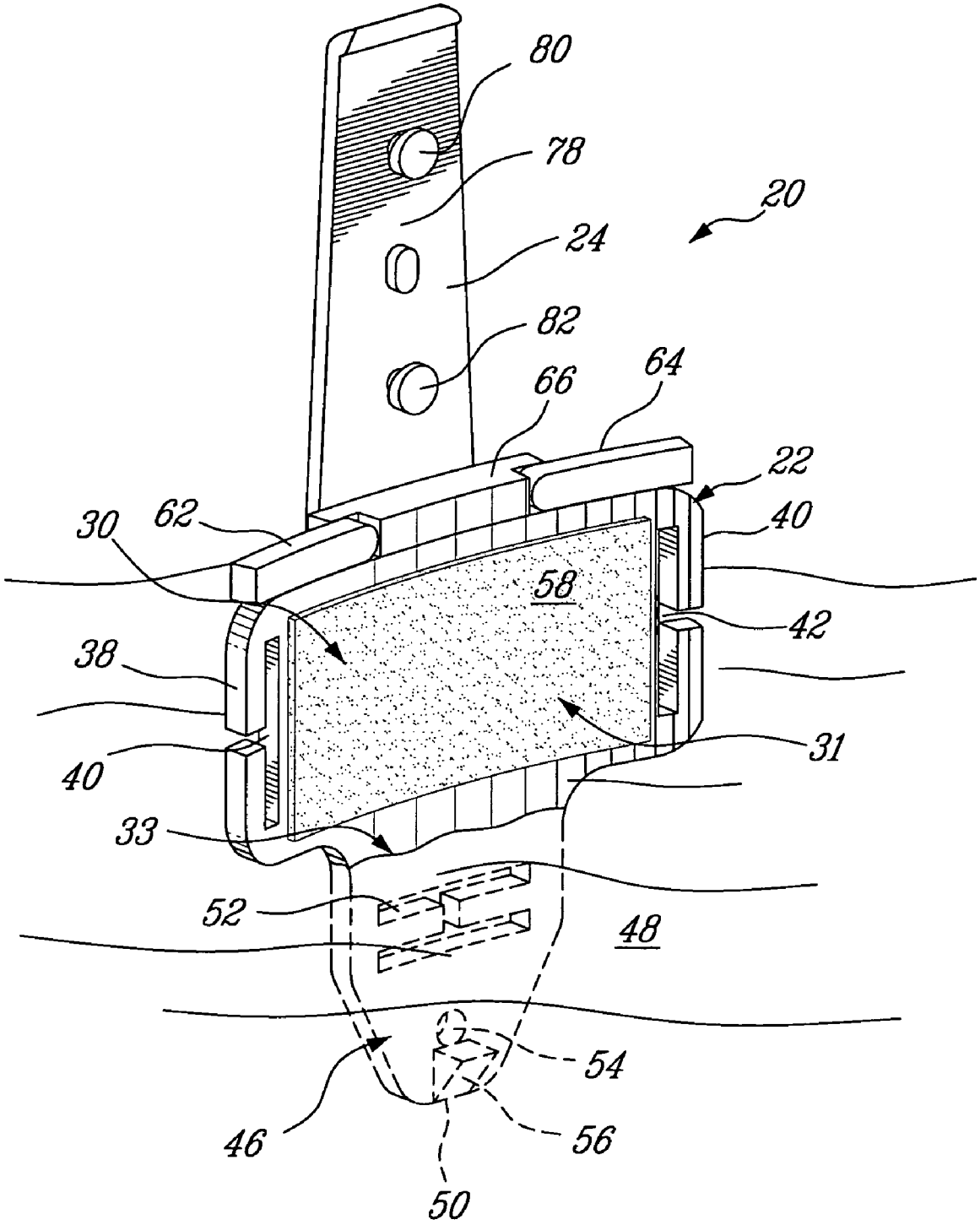
FIG. 7 shows the light support in accordance with a further embodiment of the invention anchored in a material.
Figure 9:
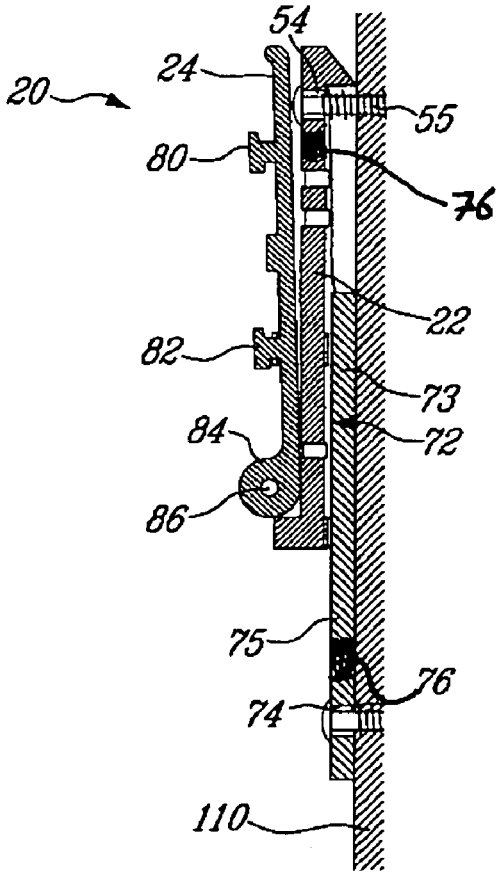
FIG. 9 is a sectional side view of the light support including an auxiliary element and mounted to a vertical surface similar to FIG. 6, yet having the light carrying plate and base plate in a folded position.

With particular reference to FIGS. 5, 6, 7, and 11, the base plate 22 includes an anchoring element 46 which is adapted to be anchored within a penetrable material 48 (typically earth, sand, gravel or the like) as shown in FIG. 7. In an example shown here, the anchoring element 46 extends from the main body 32 and is tapered towards its free end 50. The anchor 46 includes a strap receiving aperture 52. As shown in FIGS. 5, 7 and 11 the anchor element 46 also includes a fastener receiving aperture 54 to receive a fastener 55 therethrough as shown in FIGS. 6 and 9 which is to be fastened into a surface. The anchoring element 46 is also shown including in FIG. 7 a barb member 56 near its end 50.

With respect to FIG. 7, the surface mounting face 30 may be formed of a common surface covering the main body portion 32 along with extensions 34 and 36 as well as the anchoring element 46. The surface-mounting face 30 is shown including a pad member 58. Furthermore, the surface mounting face 30 may include first and second surface mounting face portions 31 and 33, as shown in FIG. 7.

The base plate 22 includes opposite faces 30 (shown in FIG. 7) and 60 (shown in FIG. 11). In this non-limiting illustrated example shown better in FIG. 10, the surface mounting face 30 is slightly concave and its opposite face 60 is correspondingly convex.

As shown in FIGS. 1, 2, 3, 4, 5, 6, 7 and 8 the base plate 22 includes opposite legs 62 and 64. Legs 62 and 64 are pivotally mounted to the base plate 22. The legs and 63 are pivotable between positions shown by arrows A and A' in FIG. 5 respectively. Specifically, in this example, the pivotable legs 62 and 64 are mounted to the base plate 22 on a side that is opposite to that of the anchoring element 46 and near the leg carrying plate 24. As better shown in FIG. 8, the leg members 62 and 64 may be provided with a curved configuration. As will be explained herein, legs 62 and 64 serve as the anti-tipping elements of the anti-tipping assembly.

A T-shaped guard member 66 covers the mounted ends of legs 62 and 64. Guard member 66 is shown including an aperture 68 in FIG. 8 through which it can receive a pivot member such as a rivet (not shown) which provides for the light support 20 to pivot about an axis Y.

The base plate 24 includes opposite fingers 68 and 70 on its face 60, which serve to snugly fit the light carrying plate 24 therebetween when it is in the folded position, as will be explained herein.

Figure 10:
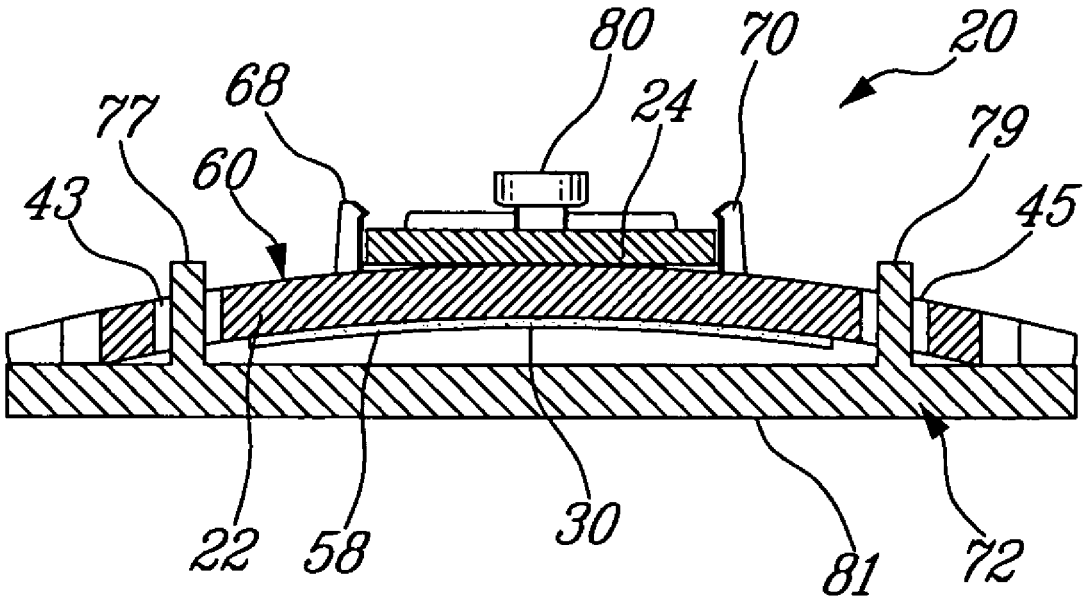
FIG. 10 is a sectional front view along line 10—10 of FIG. 6 yet having the light carrying plate and base plate in a folded position.

With reference to FIGS. 6, 9 and 10 the base plate 22 may include an auxiliary element 72. Again, in this specific example, the auxiliary element 72 is mounted to the base plate 22 and extends in a direction opposite the anchoring element 46. This auxiliary element 72 includes a fastening aperture 74 receiving a fastener 76 therethrough that is to be fastened to a surface, as will be described herein. FIGS. 6 and 9 also show that the light support 10 may include magnet members 76. The auxiliary element 72 includes first and second portions 73 and 75 respectively. In this example, the first portion 73 is an auxiliary support-mounting element and the second portion 75 is an auxiliary anchoring element. The auxiliary support-mounting element 73 includes fasteners 77 and 79 to be mounted to base plate apertures 43 and 45 respectively and support-mounting face 81 (see FIG. 10) to be mounted to a support surface. The auxiliary anchoring element includes the fastening aperture 74.

In an alternative illustrative embodiment the auxiliary element 72 may include one or more magnets 76, for example rare earth magnets, embedded therein or adhered to a surface thereof using a suitable bonding means. The magnet(s) 76 may be used for attaching the assembly to objects containing a ferrous metal, such as car bodies, steel posts or the like.

As shown in FIGS. 1, 2, 7 and 8, the light carrying plate 24 includes a light carrying face 78 having light mounting elements 80 and 82. In this way, a variety of lights 28 may be mounted thereon.

Figure 8:
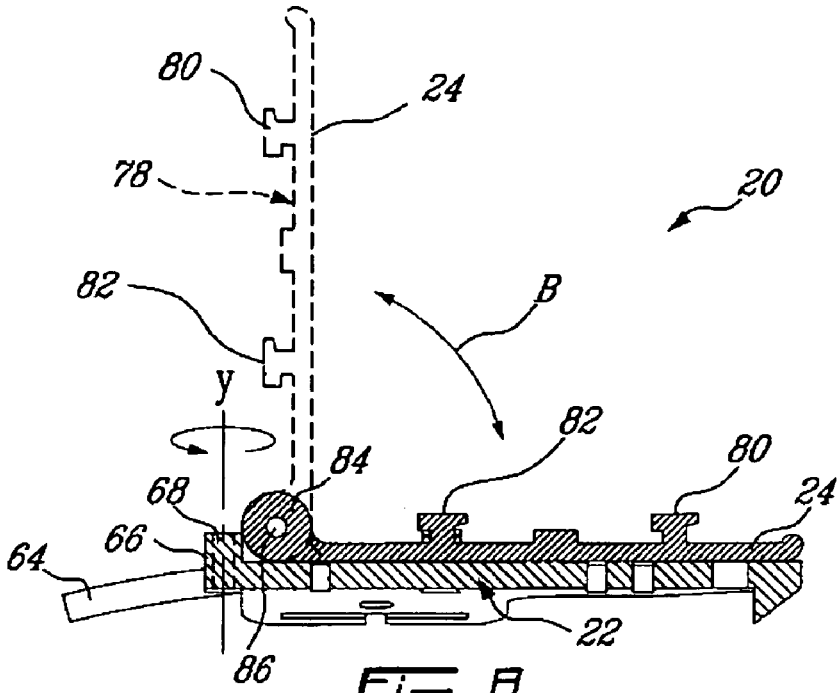
FIG. 8 is a sectional side view of FIG. 5 along line 8—8.

As aforementioned, the light carrying plate 24 is pivotally mounted to the base plate 22 at a proximal end thereof so as to move between upstanding and folded positions for example as shown by arrow B in FIG. 8. The light carrying plate 24 includes a generally cylindrical member 84 at its proximal end 26 having a aperture 85 (see FIGS. 12 and 13) in order to receive a pivot member 86 therethrough, as shown in FIGS. 8, 9, 11, 12 and 13.

With reference to FIGS. 1, 2 and 11, the base plate 22 includes light carrying plate receiving elements 88 and 90, which define a light carrying plate receiving area 92 therebetween (see FIG. 11).

The base plate 22 also includes a protective pad 93 (see FIG. 11) for receiving the light carrying plate 24 thereon.

Figure 12:
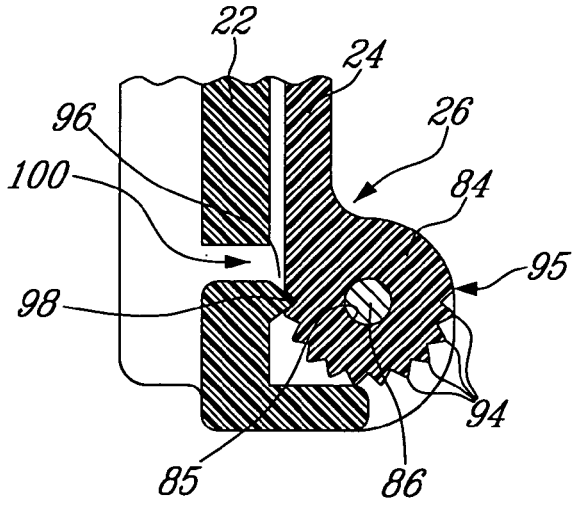
FIG. 12 is a sectional view along lines 12—12 of FIG. 11.
Figure 13:
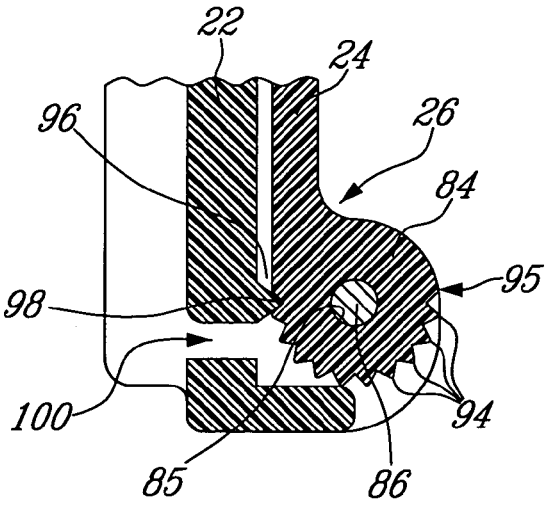
FIG. 13 is a sectional view similar to FIG. 12 in accordance with another embodiment of the present invention.

With reference to FIGS. 12 and 13, the cylindrical element 80 includes tooth elements or ridges 94 on a portion of its outer surface 95. The cylindrical element 80 and the light carrying plate-receiving area 92 define a small space 96 therebetween. The light carrying plate receiving area 92 includes a rib member 98, which extends into area 96 so as to interfere with ridges 94 as the cylindrical element 84 rotates. Furthermore, the light carrying plate-receiving area 92 includes a notch 100 adjacent to the rib 98. As shown in FIGS. 12 and 13, this notch 100 may be positioned at either side of rib 98 and provides elasticity to area 92 during pivoting of the cylindrical member 84.

In this way, the light carrying plate 22 can be set in a number of incremental positions.

Figure 14:
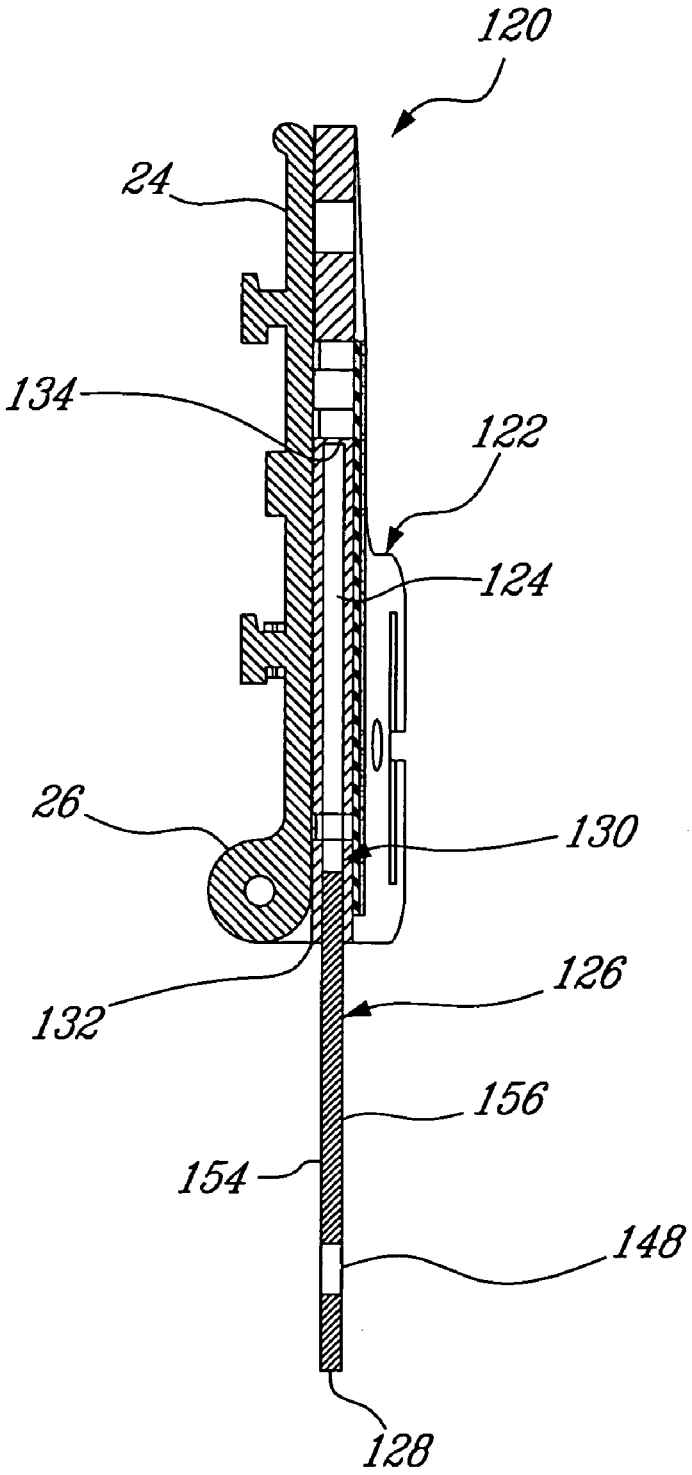
FIG. 14 is a sectional view similar to FIG. 9 in accordance with another embodiment of the present invention.
Figure 15:
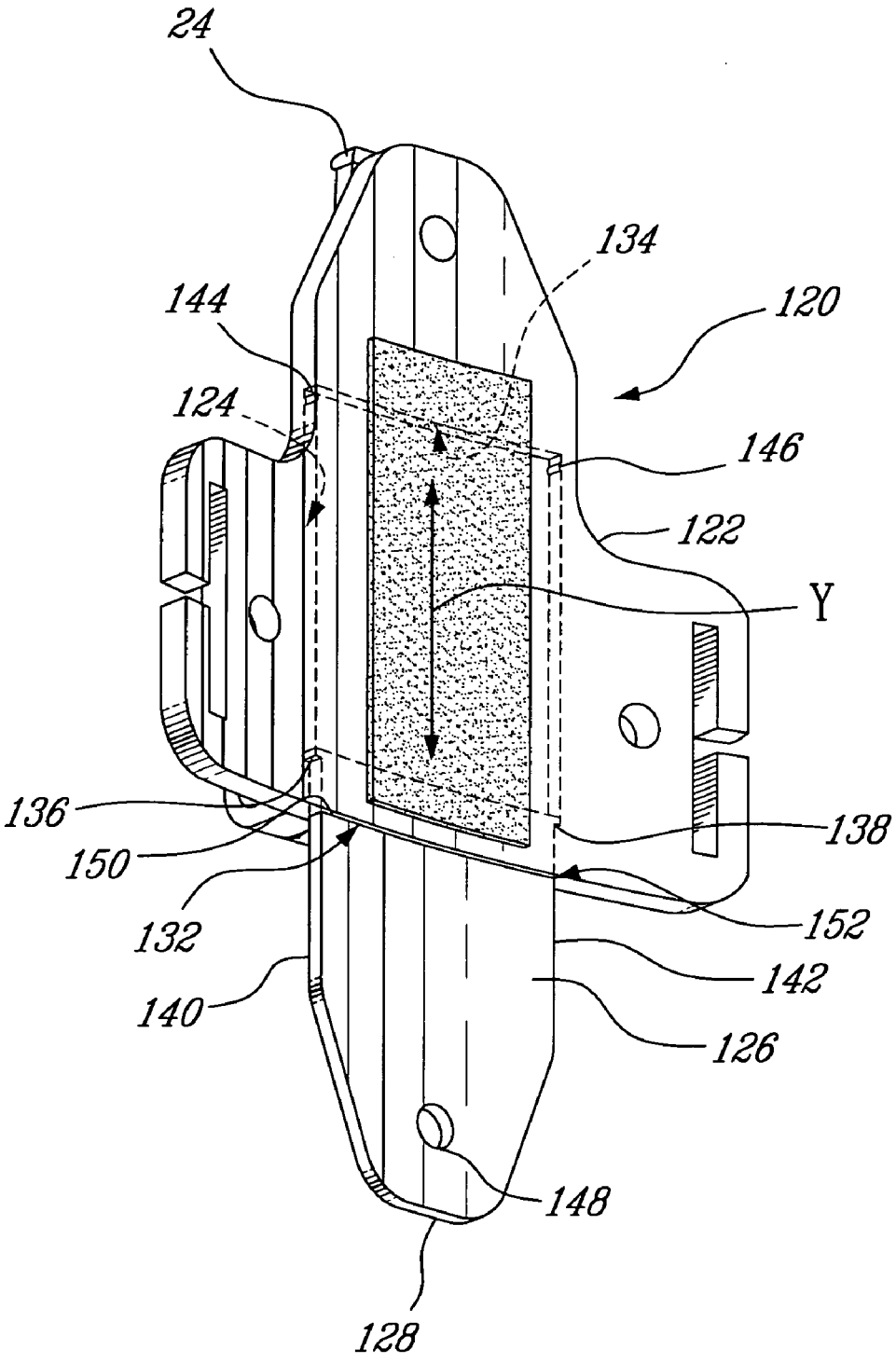
FIG. 15 is a perspective view of the embodiment of FIG. 14.

FIGS. 14 and 15 show a further embodiment of the present light support in accordance with the invention. Light support 120 is shown including a base plate 122 defining a cavity 124 that is being configured to moveably receive an auxiliary element 126 therein. The auxiliary element includes proximal and distal ends 128 and 130 respectively.

The cavity 124 is delimited by open and closed ends 132 and 134 respectively.

The auxiliary element 126 is slidably moveable within this cavity 124.

The base plate 122 and auxiliary element 126 also include mutual engaging stoppers.

The auxiliary element stoppers 136 and 138 are protruding members near the distal end 130 of the auxiliary element 126, protruding from each of its sides 140 and 142 respectively.

The auxiliary element 126 is moveable between an internal position and an external position, as shown by arrow Y.

When the auxiliary element 126 is in the internal position, its distal end stoppers 136 and 138 engage cavity stoppers 144 and 146 near the closed end so as to be maintained in the internal position. When the user pulls the auxiliary element 126 out of its cavity 124, the distal end stoppers 136 and 138 will engage base plate stoppers 150 and 152 at the open end so as to prevent the auxiliary element from being disassociated from the base plate.

The auxiliary element 126 also includes an aperture 148 so as to receive an fastener therethrough and as such be fastened to a surface. In this respect, the auxiliary element 126 opposite face 150 and 152 may be surface-mounting faces and hence, configured to co-act with a variety of surfaces.

Furthermore, the auxiliary element 126 can be an anchoring element as described herein.

As with the various light supports describes herein, light support 122 includes a light carrying plate 24 previously described.

Having now described an embodiment of the present invention, the invention will now be described in operation.

A light 28 is mounted to face 78 of the light carrying plate 24 by mounting the light carrying mounting element 80 and 82 to corresponding mounting elements on the light 28.

As shown in FIG. 3, a strap 102 can be mounted to the base plate 22 via the strap apertures 42 and 44 and as such, the light support 20 can be mounted via the strap 102 to the head 104 of a user. The light carrying plate 24 is maintained in position by fingers 68 and 70.

In FIG. 4, the light support 20 and light 28 have been mounted via a strap 102 to the waist 106 of a user. Hence, the strap 102 is worn as a belt.

In FIG. 5, the light support 20 has been placed on a flat surface 108. The light carrying plate 24 is positioned vertically and can be maintained in this position via ridges 94 which co-act with rib 98 to allow the light carrying plate 24 to be set in a variety of positions. Of course, the light carrying plate 24 may be also placed in positions other than vertical, as will be understood by a person of ordinary skill in the art.

Legs 62 and 64 are pivoted in a position opposite of the anchoring element 46 as shown in FIG. 5 and act as an anti-tipping assembly allowing the light carrying plate 24 to carry a light 28 thereon without tipping over.

In an embodiment shown in FIG. 8, the base plate 22 may be fastened to the flat surface 108 or pivotally mounted thereto as so as to pivot about axis Y.

FIGS. 6 and 9 show that the light support 20 can be fastened to a vertical surface 110 such as a wall, for example, via fasteners 55 and 76 for example.

FIG. 7 shows that the light support 20 can be anchored in a surface 48 such as earth, sand, or any other type of material. In this illustration, the light carrying plate 22 is in an upright position and hence the light 28 can be mounted thereon. Of course, the light carrying plate 24 can be positioned at different angles depending on where light 28 will be directed.

Having now described the invention in operation, a variety of other embodiments and features thereof will be herein described so as to further exemplify the invention and not limit its scope.

The base plate 22 may be provided in a variety of configurations and may be made from a variety of materials. In the non-limiting illustrated examples herein the base plate 22 is shown including one middle or main body portion 32 and extensions 34 and 36 extending from opposite sides thereof. The skilled artisan can easily understand that the base plate 22 may be provided with a variety of extensions of various configurations extending from a middle or main body portion.

The surface mounting face 30 may be flat or concave or curved. In an embodiment, the surface mounting face 30 is so concave as to lie substantially flush with a convex or curved surface such as forehead or a waist for example.

The surface mounting face 30 may include apertures for a variety of fasteners and straps; it may also include magnetic material to co-act with a magnetic surface or a suction cup to be fixed upon a surface or adhesive material. The support surface 20 need not include a pad member 58.

The light carrying plate 24 may be mounted to the base plate without a pivot and hence, in one embodiment the base plate 22 and the light carrying plate 24 may form a one piece support 20. The light carrying plate 24 may include two opposite light mounting faces 78 or may be constructed to include a variety of light mounting faces or sides. In another embodiment the light 28 may be integrally mounted to the light carrying plate 24. Furthermore, a variety of ways to set the light carrying plate between the folded position where it lies flush with the base plate and the fully extended position may also be contemplated by those having skill in the art without departing from the scope of the present invention.

A variety of lights 28 can be positioned on a variety of light carrying plates 24.

The anchoring element 46 may be provided in a variety of configurations and sizes that provide for it to be anchored within a material such as sand, earth, and the like. The anchoring element 46 may also include a portion or all of the surface mounting face 30 and as such the base plate 22 may be itself an anchoring element 46. In one non-limiting example, the anchoring element 46 includes a fork like or comb like end 50. The anchoring element 46 may include one or more barb members 56 of a variety of sizes and configurations.

A variety of anti-tipping elements, such as legs 62 and 64, that may be either pivotally mounted to the base plate 22 or fixedly mounted can be used as the anti-tipping assembly in the context of the present invention. Of course, a larger number of various legs, fingers, tabs, fins and like members can also be contemplated.

The skilled artisan will easily understand that a variety of auxiliary members 72 can be contemplated within the context of the present invention. These auxiliary elements 72 may be anchoring elements, or support mounting elements or extensions of the base plate that provide for a wider support mounting face in some cases or any combination thereof.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of preferred embodiments thereof, it can be modified, without departing from the spirit, scope and nature of the subject invention as defined in the appended claims.

What is claimed is:

1. A light support comprising:

a base plate comprising:

an anchoring element adapted to be anchored within a penetrable material;

a support-mounting face for co-acting with a surface;

a light-carrying plate comprising a proximal end mounted to said base plate being adapted for mounting a light thereon;

wherein said proximal end of said light-carrying plate is pivotally mounted to said base plate and comprises a generally cylindrical body portion pivotally mounted to said base plate and pivotable about a longitudinal axis defined thereby;

wherein said generally cylindrical body portion comprises an outer surface defining a series of longitudinal ridges on at least a part thereof; and wherein said base plate comprises a proximal end receiving portion, said proximal end receiving portion including a rib member for interfering with said longitudinal ridges to provide for said light-carrying plate to be set during pivoting of said cylindrical body portion wherein said proximal end receiving portion comprises a notch adjacent to said rib member.

2. A light support comprising:

a base plate comprising:

an anchoring element;

an antitipping assembly mounted thereto and comprising at least one anti-tipping element selected from the group consisting of a leg member, a finger member, a tab member, a barb member and a combination thereof;

a surface mounting face for co-acting with a surface; and wherein said anchoring element extends from one side of said base plate, said anti-tipping assembly being mounted to an opposite side of said base plate; and a light-carrying plate comprising a proximal end mounted to said base plate and being adapted for mounting a light thereon;

wherein when said surface mounting face is positioned on a generally horizontal surface and said light carrying plate carries a light thereon, said anti-tipping assembly resists said light support tipping over.

3. The light support according to claim 1, wherein said anti-tipping assembly comprises a leg member.

4. The light support according to claim 1, wherein said anti-tipping assembly comprises a pair of leg members.

5. The light support according to claim 4 wherein said leg members are pivotally mounted to said base member.

6. The light support according to claim 4, wherein said leg members have a curved configuration.

7. The light support according to claim 1, wherein said light carrying plate is pivotally mounted to said base plate.

8. A light support comprising:

a base plate comprising:

an anchoring element adapted to be anchored within a penetrable material; a surface mounting face for co-acting with a surface;

an auxiliary element; and wherein said anchoring element extends from one side of said base plate, said auxiliary element extending from an opposite side of said base plate; and a light-carrying plate comprising a proximal end mounted to said base plate and being adapted for mounting a light thereon;

wherein said surface mounting face spans a common face defined by said base plate, said anchoring element and said auxiliary element.

9. The light support according to claim 8, wherein said auxiliary element is an auxiliary anchoring element.

10. The light support according to claim 8, wherein said auxiliary element is an auxiliary support mounting element mounted to said surface mounting face.

11. The light support according to claim 8, wherein said auxiliary element comprises an auxiliary support mounting element and an auxiliary anchoring element.

12. The light support according to claim 8, wherein said auxiliary element comprises strap-receiving apertures.

13. The light support according to claim 8, wherein said auxiliary element comprises a fastener-receiving aperture.

14. The light support according to claim 8, wherein said auxiliary element is movably mounted to said base plate.

15. The light support according to claim 8, wherein said base plate defines a cavity for slidably receiving said auxiliary element therein.

16. The light support according to claim 8, wherein said cavity is delimited by opposite closed and open ends and opposite side walls.

17. The light support according to claim 15, wherein said auxiliary element is moveable between an internal position and an external position.

18. The light support according to claim 17, wherein said auxiliary element comprises opposite distal and proximal ends, said distal end being near said cavity closed end when in said integral position, said proximal end protruding through said cavity open end when in said external position.

19. The light support according to claim 18, wherein said auxiliary element distal end is flush with said cavity closed end when in said internal position.

20. The light support according to claim 18, wherein said auxiliary element comprises opposite distal and proximal ends, said auxiliary element including stoppers positioned near said distal ends, said base plate including stoppers near said cavity open end, said distal end stoppers engaging said cavity open end stoppers when said auxiliary element is in said external position.

21. The light support according to claim 20, wherein said base plate comprises stoppers near said cavity closed end.

22. The light support according to claim 21, wherein said base plate cavity closed end stoppers are protrusion members formed on each said opposite side wall, said auxiliary element stoppers engaging said protrusion members when in said internal position.

23. The light support according to claim 15, wherein said auxiliary element and said base plate include mutually engaging stoppers so as not to be disassociated.

24. The light support according to claim 23, wherein said auxiliary element is flat longitudinal body having opposite sides, said stoppers comprising a protrusion as each said opposite side.

25. A light support according to claim 8, wherein said auxiliary element is an anchoring member.

26. A light support according to claim 8, wherein said auxiliary element comprises a surface mounting face.

* * * * *